US005906225A

United States Patent [19]

Stark et al.

[11] Patent Number: 5,906,225

[45] Date of Patent: May 25, 1999

[54] ORIFICE TUBE TYPE REFRIGERANT EXPANSION VALVE ASSEMBLY WITH COMBINED PARTICULATE AND NOISE ATTENUATION FILTERS

[75] Inventors: Terrence Lee Stark, Shelby; James C. Ostrand, Lenox; George Richard Kubasinski, Sterling Heights, all of Mich.

[73] Assignee: General Motors Corporation, Detroit, Mich.

[21] Appl. No.: 08/926,504

[22] Filed: Sep. 10, 1997

[51] Int. Cl.[6] ..... F15D 1/02

[52] U.S. Cl. ..... 138/41; 138/42; 138/44

[58] Field of Search ..... 138/44, 42, 40, 138/41

[56] References Cited

U.S. PATENT DOCUMENTS

| | | | |
|---|---|---|---|
| 2,195,925 | 4/1940 | Hoesel | 138/41 |
| 2,375,646 | 5/1945 | Grossi | 138/41 |
| 2,576,610 | 11/1951 | Kunzog | 138/41 |
| 3,109,459 | 11/1963 | Lee, II et al. | 138/41 |
| 3,642,030 | 2/1972 | Amick | 138/45 |
| 3,677,300 | 7/1972 | King | 138/42 |
| 3,820,571 | 6/1974 | Grier | 138/44 |
| 4,009,592 | 3/1977 | Boerger | 138/41 |
| 4,079,750 | 3/1978 | Ludwig | 138/42 |
| 4,150,696 | 4/1979 | Meier et al. | 138/44 |
| 5,036,948 | 8/1991 | Henn | 181/258 |
| 5,097,866 | 3/1992 | Shapiro-Baruch et al. | 138/41 |

*Primary Examiner*—Denise L. Ferensic
*Assistant Examiner*—James F. Hook
*Attorney, Agent, or Firm*—Jeffrey A. Sedlar; Patrick M. Griffin

[57] ABSTRACT

An orifice tube refrigerant expansion valve has an upstream particulate filter of novel design and a downstream expansion noise attenuation filter with a fail safe flow provision. The upstream particulate filter is a truncated cone of porous filter material that forms a thin manifold space inside the refrigerant line, forcing refrigerant flow into a small central bore of the filter and concentrically into the orifice tube. Leaving the orifice tube, the flow is forced axially end to end through a cylindrical body of noise muffling, porous material. Should the noise muffling cylinder become blocked, it shifts piston-like to open a bypass passage around its outer surface so that flow is not blocked through the line.

3 Claims, 4 Drawing Sheets

ORIFICE TUBE TYPE REFRIGERANT EXPANSION VALVE ASSEMBLY WITH COMBINED PARTICULATE AND NOISE ATTENUATION FILTERS

TECHNICAL FIELD

This invention relates to automotive air conditioning systems with orifice tube type refrigerant expansion valves, and specifically to an expansion valve assembly with particulate filtering and noise attenuation features.

BACKGROUND OF THE INVENTION

Automotive air conditioning systems require an expansion valve in the refrigerant line that runs between the condenser and low evaporator to expand the high pressure refrigerant leaving the condenser to a sufficiently low pressure to cool the evaporator. The least expensive and most common design for the expansion valve is a simple, small diameter metal tube that is held concentrically within the refrigerant line. High pressure refrigerant inlet flow reaching the tube is quickly throttled down to a high velocity flow that expands quickly when it leaves the tube. While such valves are inexpensive and reliable, the quick contraction and expansion of the flow inherently produces a certain level of hissing noise. A typical means for deadening this noise is a relatively large volume, canister type muffler, similar to that used with air conditioning compressors. These are large and costly, though effective. Another drawback of small diameter orifice tubes is the necessity to prevent them being plugged by the particulate contaminants inevitably found in refrigerants, such as metal filings or rubber seal detritus. A nylon screen upstream of the orifice tube is often used to screen particulates out, but it has a limited filter capacity, and provides no noise muffling function.

SUMMARY OF THE INVENTION

The invention provides an orifice tube expansion valve assembly with improved particulate filtering and noise attenuation, which replaces the nylon screen and large in-line muffler with dedicated filters that cooperate uniquely with the orifice tube and the refrigerant line that surrounds it.

In the preferred embodiment disclosed, a refrigerant inlet particulate filter is located upstream of the orifice tube, and a noise attenuation filter is located downstream. The particulate filter is basically a cylinder of porous material, located within the refrigerant line, the downstream end of which abuts the inlet to the orifice tube. The inlet filter is smaller in outside diameter than the surrounding refrigerant line, forming a thin, annular manifold space therewith. A central bore within the inlet filter is closed at the upstream end, but open at the downstream end and abutted directly and concentrically to the inlet of the orifice tube. Refrigerant flow entering the manifold space around the inlet filter is forced radially through the outer surface of the inlet filter and into the central bore before entering the orifice tube. Particulates are trapped over almost the entire length and volume of the inlet filter, and the inlet flow is guided smoothly into the matched size orifice tube, which also helps to prevent noise at the tube inlet.

The noise attenuation filter at the outlet of the orifice tube is formed from a similar porous material, but its primary purpose is noise reduction rather than particulate filtering. Though porous, it is a solid cylinder, with no central bore, and refrigerant exiting the outlet of the orifice tube is forced axially through the entire length of the outlet filter, end to end. The porosity and length of the outlet filter are sufficient to dampen and muffle much of the outlet noise, in a package smaller than a typical in-line muffler. In addition, in the embodiment disclosed, the outlet filter is slidably contained within a guide sleeve that forms a radial clearance space within the surrounding refrigerant line. The noise filter is normally located far enough upstream within the sleeve so as to block several bypass ports cut through the sleeve, which would otherwise open into the radial clearance space. Should the noise filter become blocked by particulates escaping the inlet filter, the pressure of the blocked flow is sufficient to push the noise filter downstreameam, flattening a crush washer, and opening the bypass ports to let flow through, as a fail safe.

BRIEF DESCRIPTION OF THE DRAWINGS

These and other features of the invention will appear from the following written description, and from the drawings, in which.

DESCRIPTION OF THE PREFERRED EMBODIMENT

Figure 6:
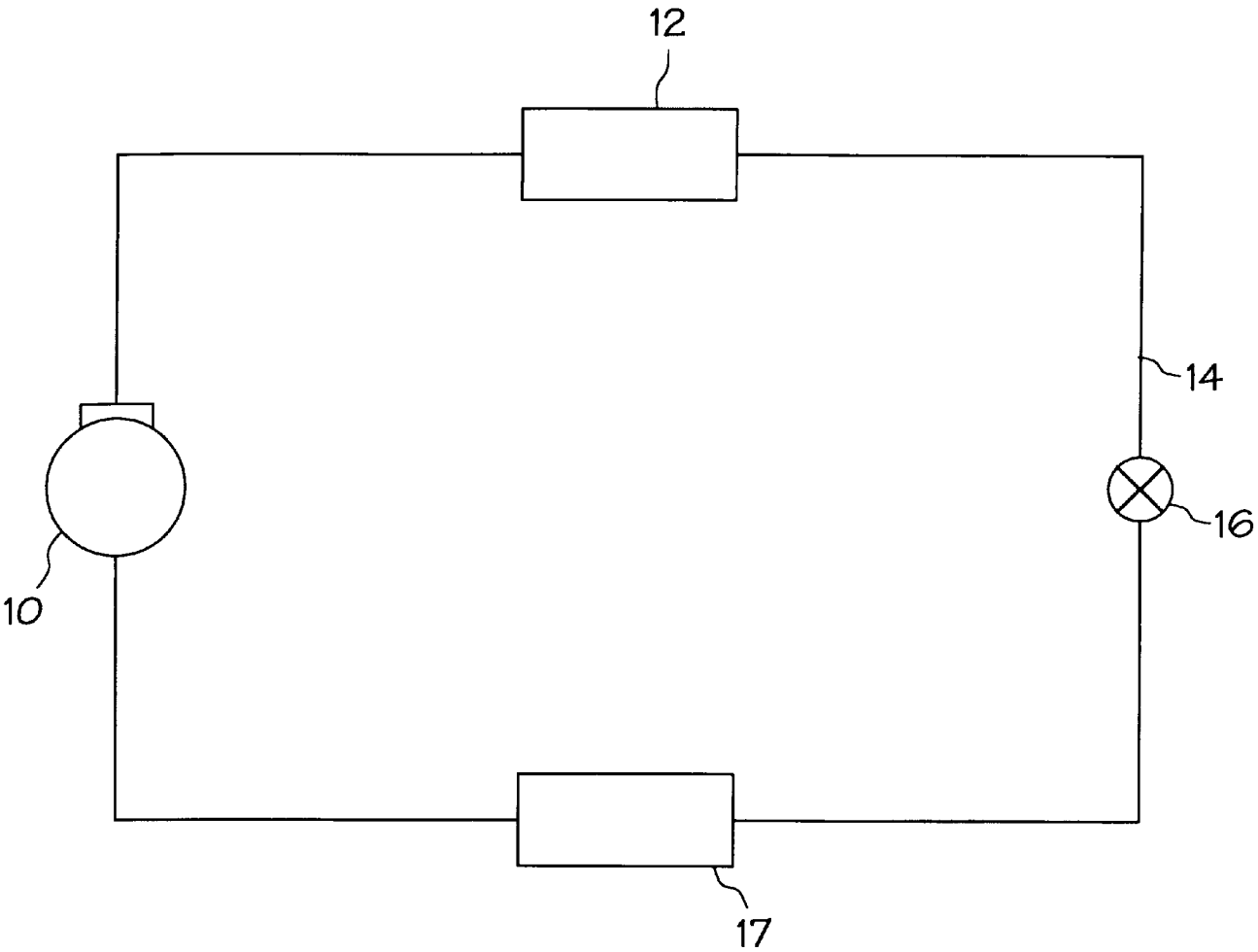
FIG. 6 is a schematic diagram showing the basic relationship of the expansion valve assembly of the invention to the other major components of an automotive air conditioning system.

Referring first to FIG. 6, a basic automotive air conditioning system incorporates a compressor 10 that compresses low pressure, heated refrigerant vapor and sends it to condenser 12, where heat is rejected to ambient. From there, high pressure liquid refrigerant flows through a refrigerant line 14 to the expansion valve assembly 16, where it is expanded into a low pressure vapor that enters evaporator 17. Heat is picked up by the low pressure refrigerant vapor from the vehicle interior in evaporator 17, which flows again to compressor 10 to begin the cycle over again. As the refrigerant flow is rapidly contracted and expanded in the reduced diameter orifice tube of the expansion valve assembly 16, it produces a pulsating hissing noise. At start up and shut down, a surging type of hissing noise can be produced. In addition, the refrigerant can be expected to carry particulate contaminants in a fairly predictable size range, consisting of metal shavings, small pieces of seal material, etc. The expansion valve assembly of the invention is designed to deal with each of these inherent problems.

Figure 4:
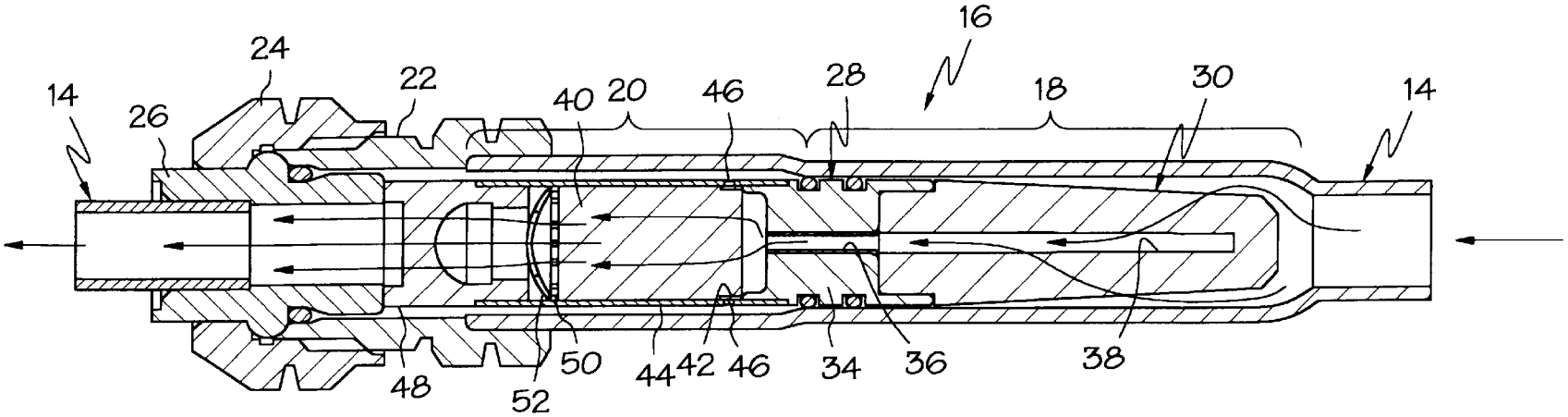
FIG. 4 is a cross section of the expansion valve assembly installed in the refrigerant line, operating normally.

Referring next to FIG. 4, in understanding the details of the expansion valve assembly 16 of the invention, it is helpful to first describe in more detail the section of the refrigerant line 14 into which it is installed, and relative to which its basic components are designed. The refrigerant line 14 can be broken and reattached in order to allow valve assembly 16 to be installed, and potentially replaced, if needed. Upstream of the point where line 14 is parted, it is flared out and enlarged into a stepped diameter valve housing comprising a smaller barrel 18 with an inner diameter of approximately 14 mm that merges sharply into a larger barrel 20 with an inner diameter of approximately 15 mm, with a total end to end length of the two of approximately 90 mm. The end of the barrel 20 is brazed to a stationary threaded coupling 22 that threads inside a free turning ring 24. The ring 24 draws a sealed end fitting 26 tightly up within the threaded coupling 22 to rejoin the parted refrigerant line 14 and ultimately seal the installed valve assembly 16 inside. Details of the valve assembly 16 and its relation to these features of the refrigerant line 14 are descried next.

Figure 1:
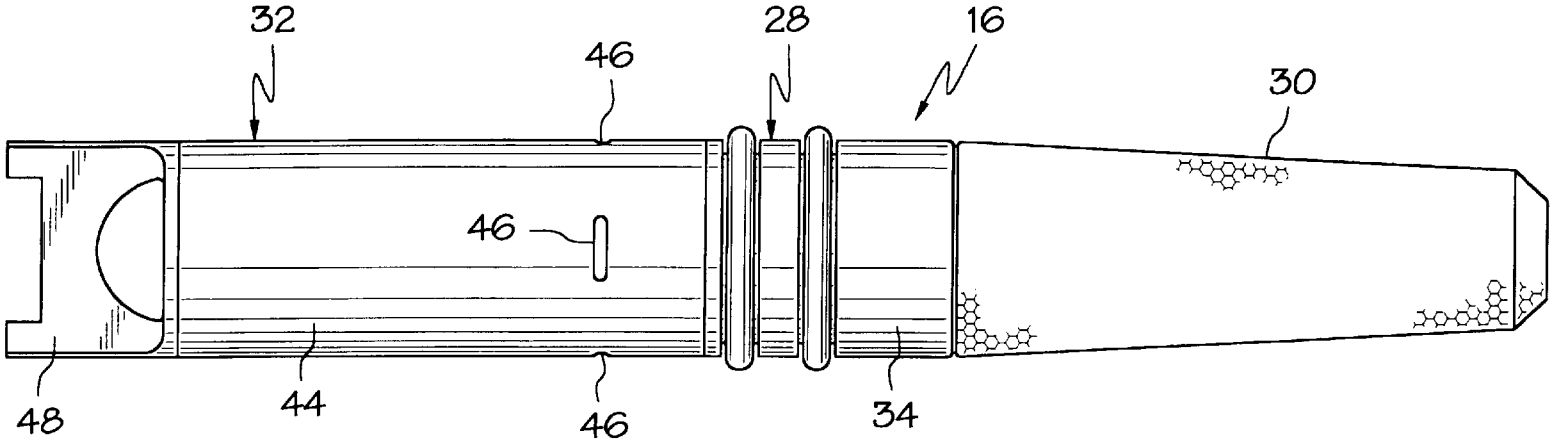
FIG. 1 is a side elevation view of a preferred embodiment of the expansion valve assembly of the invention, prior to installation into the refrigerant line between condenser and evaporator.
Figure 2:
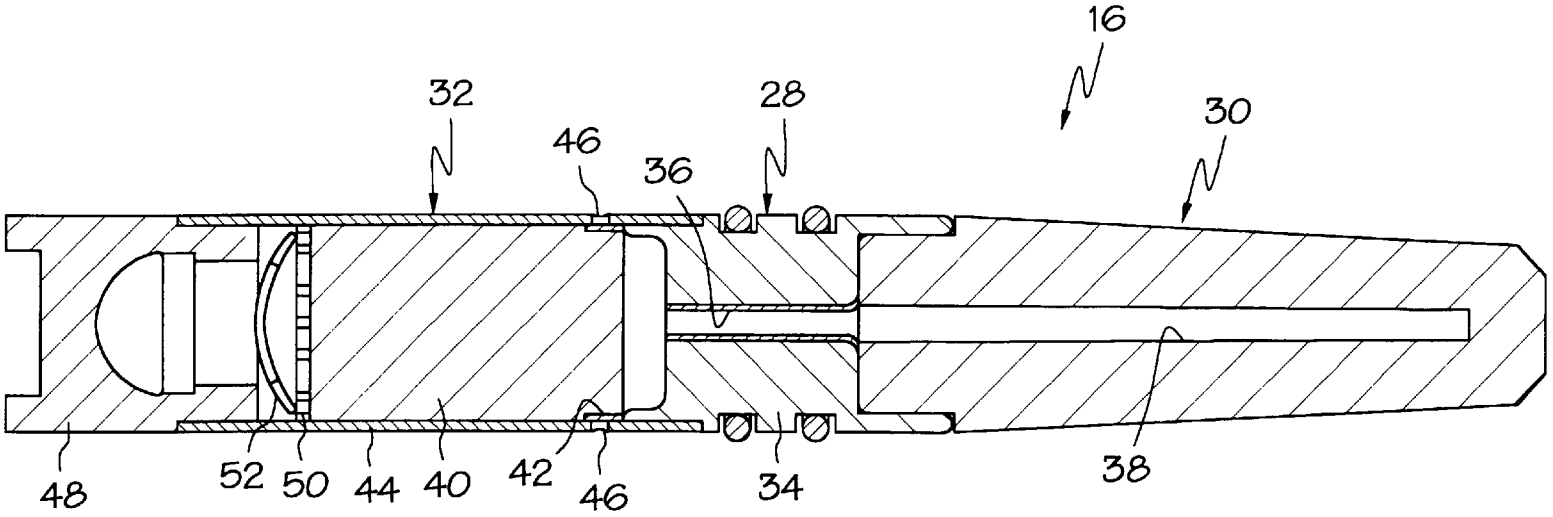
FIG. 2 is a cross section of FIG. 1.

Referring next to FIGS. 1 and 2, the valve assembly 16 of the invention comprises three basic components, including the expansion valve itself, indicated generally at 28, an inlet filter upstream therefrom, indicated generally at 30, and a noise attenuation filter downstream therefrom, indicated generally at 32. The expansion valve 28 is basically a conventional orifice tube type valve, with a non porous, cylindrical body 34, molded of rigid plastic, that fits fluid tight within the end of the smaller diameter barrel 18, just before it merges into the larger diameter barrel 20. Running through the center of body 34 is a metal orifice tube 36, which is approximately 12 mm long and 2 mm in inner diameter, with a slightly flared inlet end. As high pressure liquid refrigerant flow from the condenser 12 reaches the sealed valve body 34, it is quickly forced through the reduced diameter orifice tube 36, accelerating its flow and expanding it into a lower pressure vapor or mist suitable for heat absorption in the evaporator 17. A certain level of noise is inherently involved in such an abrupt flow restriction, mostly at the outlet, but some noise occurs at the inlet as well. In addition, it is important that particulates not clog the orifice tube 36. The inlet filter 30 upstream of expansion valve 28 deals with both concerns at the inlet to tube 36. Inlet filter 30 is a one piece molding of plastic material, such as polypropylene, consisting of small contiguous spheres, or otherwise configured so as to give a consistent porosity in the range of 180–270 microns. Inlet filter 30 is shaped on the outside as a shallow, truncated cone, tapering from a smallest outside diameter at the upstream end of approximately 10 mm over about 44 mm of axial length to a largest outside diameter at the downstream end of approximately 12 mm. The downstream end of filter 30 plugs concentrically into the valve body 34, abutted to the inlet end of tube 36. In addition to being porous, inlet filter 30 is not solid. At the center, a thin cylindrical central bore 38 with a diameter of approximately 2.5 mm runs axially from the downstream end almost to the upstream end. As such, the open end of the central bore 38 abuts concentrically to the orifice tube 36, substantially matched in diameter.

Figure 3:
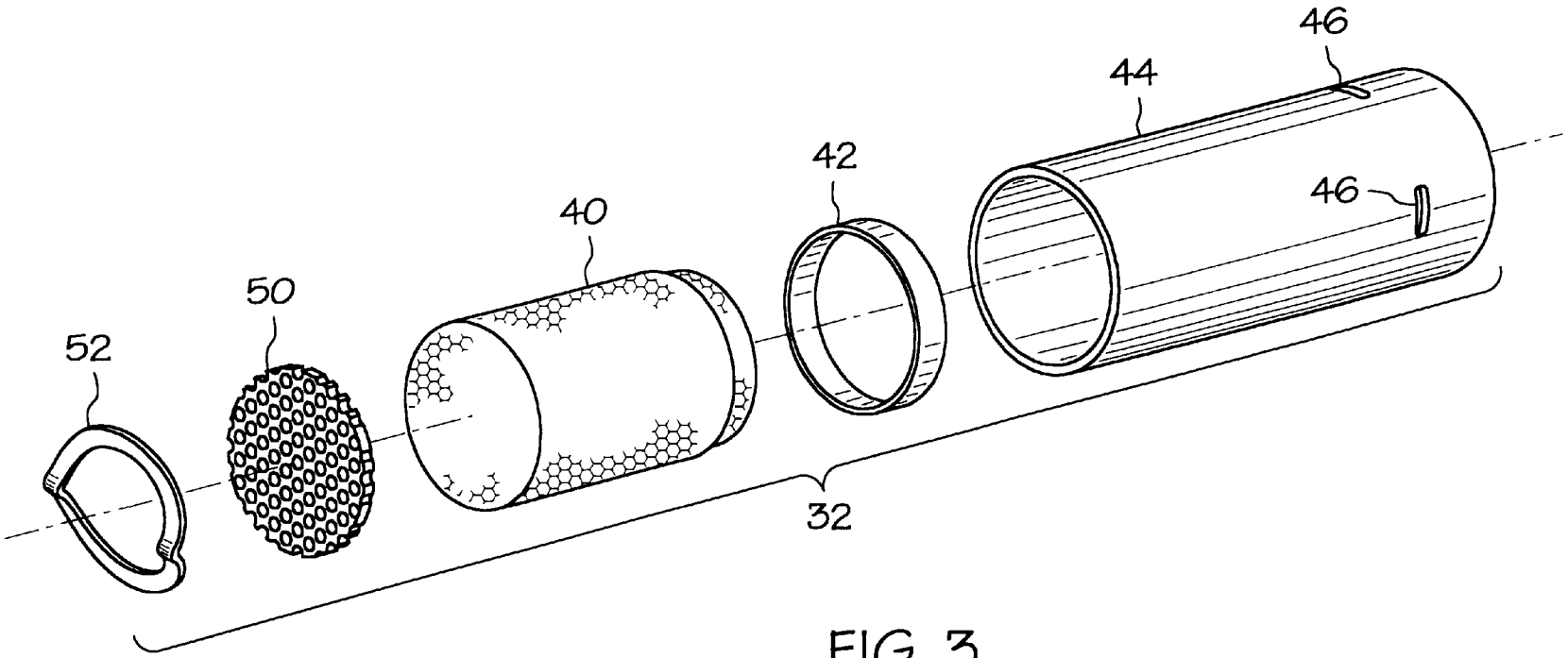
FIG. 3 a perspective view of the noise attenuation filter.

Referring next to FIGS. 2 and 3, the final basic component of the valve assembly 16, and the outlet noise attenuation filter 32, is a subassembly of several combined structures, the most significant of which is a central cylindrical body 40 formed of the same material as inlet filter 30. Filter body 40 is solid, meaning that it has no interior voids, but is porous, within the same porosity range as the inlet filer 30. As disclosed, central filter body 40 has an outside diameter of approximately 12.5 mm and an axial length of approximately 20 mm. Filter body 40 is completely symmetrical and continuous, but for a narrow rubber or plastic ring 42 inset flush into its outer surface at the edge of the upstream end, which is 2–3 mm wide and non porous. The filter body 40 is contained with very close tolerances of +/−0.04 mm within a rigid plastic guide sleeve 44, which has an outside diameter of approximately 13.5 mm and an axial length of approximately 35 mm. Guide sleeve 44 is continuous and uninterrupted but for a series of four evenly spaced bypass ports 46, near the downstream end, which are 1 mm wide and 3 mm long. The upstream end of guide sleeve 44 fits tightly over expansion valve body 34. The filter body 40 is normally bottomed out within guide sleeve 44 against the valve body 34, leaving an empty axial space of about 4–5 mm length relative to the upstream end of filter body 40, with the non porous end ring 42 axially aligned with the bypass ports 46. The downstream end of guide sleeve 44 fits tightly over an open, rigid plastic end plug 48, leaving about a 4–5 mm space relative to the downstream end of the filter body 40. Two components sit within that space. A thin, round aluminum screen 50, about one mm thick, abuts directly to the downstream end of the outlet filter body 40. Screen 50 has a mesh size substantially larger than the porosity of filter body 40. Sitting against screen 50 is an axially yieldable crush washer 52, which crushes from a normal axial thickness of approximately 4 mm down to about one mm when subjected to a force in the rage of 20 to 30 pounds. Screen 50 and crush waster 52 are dropped against the downstream end of filter body 44 before end plug 48 is pushed into the end of sleeve 44, to which it may be fixed by spin welding. Plug 48 completes the valve assembly 16, and its installation into line is described next.

Referring next to FIGS. 3 and 4, the completed valve assembly 16 is installed by dropping it axially through the threaded coupling 22 and into the larger diameter barrel 20 of the flared end of refrigerant line 14. The end plug 48 is pushed axially inward until resistance is felt, which will be when the outside of the expansion valve body 34 makes sealing contact with the inner surface of the smaller diameter barrel 18. Then, the free turning threaded ring 24 is twisted over the threaded coupling 22, as described above, which pulls the sealed end fitting 26 into abutment with the end plug 48 to finally seat the assembly 16 in place. Post installation, upstream of the expansion valve 28, and the outer surface of the inlet particulate filter 30 creates a long, thin manifold space, a millimeter or two radially thick, relative to the inner surface of the smaller diameter barrel 18. Downstream of the expansion valve 28, the outer surface of guide sleeve 44 creates a long equally radially thin bypass space relative to the inner surface of the larger diameter barrel 20. However, that space is closed off, in the normal position of the outlet filter body 40 shown in FIG. 4.

Referring next to FIG. 4, the normal flow operation of the invention is illustrated. In normal flow operation, inlet refrigerant flow through refrigerant line 14 enters the narrow space between the inlet filter 30 and the inner surface of the smaller diameter barrel 18, where it is blocked by the sealed valve body 34. Consequently, the inlet flow is forced radially inwardly through the porous outer surface of inlet filter 30, along essentially all of its length, and radially inwardly into the central bore 38, as shown by the arrows. The porosity of filter 30 is sufficient to pass the refrigerant flow, without significantly decreasing its normal flow pressure of approximately 150–250 psi. However, most entrained particulates in the flow will be picked up and trapped by the inlet filter 30, which is primarily intended for that task. Inlet filter 30 presents a good deal of surface area and particularly volume to the inlet flow, considering its length and radial wall thickness, as compared to a conventional thin screen. It is also far more rigid than a thin screen. Beyond its particulate capture function, however, the inlet filter 30 also serves to assist the inlet flow into the orifice tube 36 and muffle noise, which a conventional inlet screen does not. The inlet flow, as it is forced continually into the central bore 38, is fed concentrically into the inlet of the orifice tube 36, precontracted, in effect and guided smoothly into the tube 36. The orifice tube inlet noise referred to above is reduced by virtue of the fact that the inlet end of the orifice tube 36 is encased in and muffled by the inlet filter 30, even though the flow has already passed through it. Downstream of the orifice tube 36, where the majority of the noise occurs, outlet flow enters the narrow axial space and then is forced to flow through the outlet filter body 40, axially end to end. No flow is able to reach the bypass ports 46, which are blocked by the ring 42. As with the inlet filter 30, flow passes through readily enough so as not to significantly reduce the normal flow pressure. The tube outlet flow noise is muffled and muted, however, by virtue of being pushed through a tortuous path through the entire length of porous filter body 40, and this noise attenuation is its primary function, as opposed to particle trapping. However, given the fact that its material and porosity is comparable to the inlet filter 30, noise filter body 40 could trap particulates, incidental to its noise muffling operation. The outlet screen 50 prevents any large particulates from passing through, as well as providing a hard wear surface for the crush washer 52. However, should the outlet filter body 40 become clogged and plugged, a fail safe mode, described next, acts to maintain refrigerant flow.

Figure 5:
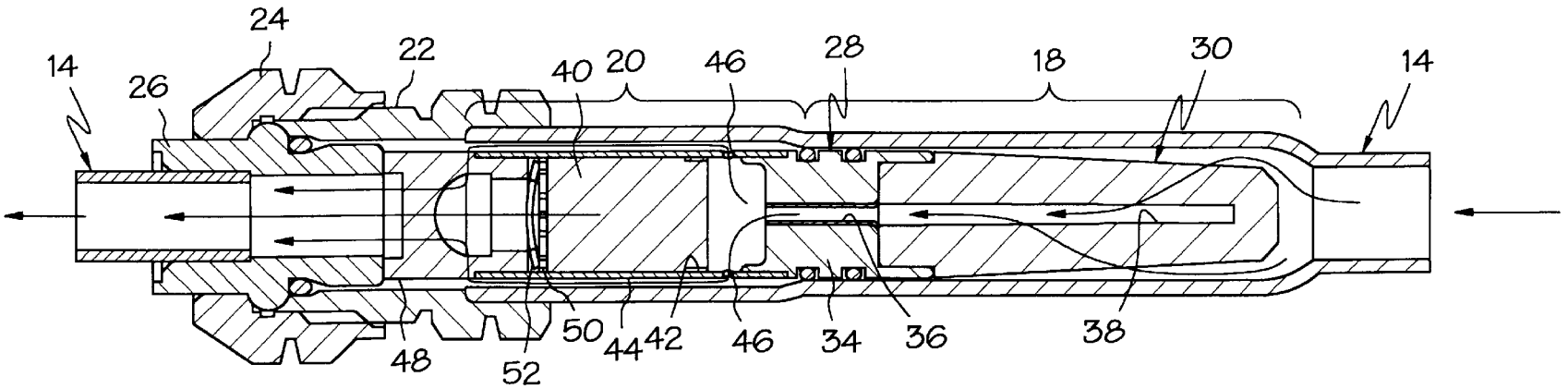
FIG. 5 is a view like FIG. 4, but showing the downstream noise attenuation filter being bypassed in response to blockage.

Referring next to FIG. 5, if the outlet filter body 40 becomes sufficiently plugged with trapped particulates to block refrigerant flow through it, its downstream end, facing the outlet of orifice tube 36, acts like a piston. Because of its relatively large end surface area, which is as large as the valve body 34, the filter body 40 develops a significant force in reaction to the pressure of the blocked flow. Because of the closely held tolerance between the guide sleeve 44 and the filter body 40 noted above, as little as five pounds developed force would begin to shift the filter body 40 in the direction of flow, and enough force could be developed to flatten the crush washer 52. Once filter body 40 has shifted a millimeter or two to the left, the ring 42 moves axially far enough to open up the four bypass ports 46, and flow can enter the radial space around the outside of guide sleeve 44 to ultimately bypass the noise attenuating outlet filter body 40 completely. This would, of course, terminate the outlet noise reduction, but normal refrigerant flow would be assured. A resumption of valve noise would serve as an audible signal to replace the entire assembly 16, which could be easily done.

Variations in the preferred embodiment disclosed could be made. The fail safe function provided by the ported guide sleeve 44 and crush washer 52 might be unnecessary where particulate contaminants were not present in the system, or otherwise controlled, so that outlet plugging was not considered to be a problem. In that case, only the outlet noise attenuating filter body 40 would be necessary, held in abutment to the outlet of the orifice tube 36 by end plug 48 or any other retention means. The central bore 38 in inlet filter 30 could be larger than the inlet into the orifice tube 36, so long as it was still abutted concentrically to it. An inlet filter 30 with a larger diameter central bore 38 would still provide a robust particulate trap with a good deal of effective volume presented to the inlet flow. Size matching the bore 38 close to the inlet end of the orifice tube 36 helps in guiding the inlet flow smoothly into the tube 36, providing orifice tube inlet noise reduction, even though the noise problem is more severe at the outlet end of the orifice tube 36. To reduce parts, the guide sleeve 44 could be molded integrally to the orifice tube body 34, since they can be the same plastic material. Therefore, it will be understood that it is not intended to limit the invention to just the embodiment disclosed.

We claim:

1. For use in the refrigerant line connecting a condenser and evaporator in an automotive air conditioning system in which the refrigerant carries particulate type contaminants, a refrigerant expansion valve with combined inlet particulate filter and valve outlet noise attenuation features, comprising:

an expansion valve located within said refrigerant line and having a central, cylindrical orifice tube to receive high pressure refrigerant inlet flow from said condenser and expand it into a low pressure outlet flow for use in said evaporator, thereby creating expansion noise;

a refrigerant inlet filter located within said refrigerant line upstream from said expansion valve, said inlet filter comprising an elongated, porous material cylinder with an upstream end having an outside diameter slightly less than the diameter of said refrigerant line, a downstream end having an outside diameter substantially equal to said refrigerant line, and a substantially cylindrical central bore extending for substantially the entire length of said inlet filter, but open only at the downstream end of said inlet filter and abutted concentrically to said orifice tube, whereby a thin, annular inlet manifold space is formed between the outside of said inlet filter and said refrigerant line that forces refrigerant to flow radially inwardly through said inlet filter and into said central bore over substantially the entire axial length of said inlet filter, said inlet filter having a porosity sufficiently small to trap refrigerant particulate contaminants; and a noise attenuation filter located within said refrigerant line downstream of said expansion valve, said noise filter comprising an elongated porous material cylinder substantially equal in outside diameter to said refrigerant line, so that refrigerant outlet flow from said expansion valve orifice tube is forced through the entire axial length of said noise attenuation filter, said noise filter having a porosity sufficiently small and an axial length sufficiently large to substantially muffle said refrigerant expansion noise as said refrigeration outlet flow runs through it.

2. For use in the refrigerant line connecting a condenser and evaporator in an automotive air conditioning system in which the refrigerant carries particulate type contaminants, a refrigerant expansion valve with combined inlet particulate filter and valve outlet noise attenuation features;, comprising:

an expansion valve located within said refrigerant line and having a central, cylindrical orifice tube to receive high pressure refrigerant inlet flow from said condenser and expand it into a low pressure outlet flow for use in said evaporator, thereby creating expansion noise;

a refrigerant inlet filter located within said refrigerant line upstream from said expansion valve, said inlet filter comprising an elongated, porous material cylinder with an upstream end having an outside diameter slightly less than the diameter of said refrigerant line, a downstream end having an outside diameter substantially equal to said refrigerant line, and a substantially cylindrical central bore having a diameter substantially equal to said orifice tube and extending for substantially the entire length of said inlet filter, but open only at the downstream end of said inlet filter and abutted concentrically to said orifice tube, whereby a thin, annular inlet manifold space is formed between the outside of said inlet filter and said refrigerant line that forces refrigerant to flow radially inwardly through said inlet filter and concentrically into said central bore and abutted orifice tube over substantially the entire axial length of said inlet filter, said inlet filter having a porosity sufficiently small to trap refrigerant particulate contaminants; and a noise attenuation filter located within said refrigerant line downstream of said expansion valve, said noise filter comprising a solid, elongated porous material cylinder substantially equal in outside diameter to said refrigerant line, so that refrigerant outlet flow from said expansion valve orifice tube is forced through the entire axial length of said noise attenuation filter, said noise filter having a porosity sufficiently small and an axial length sufficiently large to substantially muffle said refrigerant expansion noise as said refrigeration outlet flow runs through it.

3. For use in the refrigerant line connecting a condenser and evaporator in an automotive air conditioning system in which the refrigerant carries particulate type contaminants, a refrigerant expansion valve with combined inlet particulate filter and valve outlet noise attenuation features, comprising:

an expansion valve located within said refrigerant line and having a central, cylindrical orifice tube to receive high pressure refrigerant inlet flow from said condenser and expand it into a low pressure outlet flow for use in said evaporator, thereby creating expansion noise;

a refrigerant inlet filter located within said refrigerant line upstream from said expansion valve, said inlet filter comprising an elongated, porous material cylinder with an upstream end having an outside diameter slightly less than the diameter of said refrigerant line, a downstream end having an outside diameter substantially equal to said refrigerant line, and a substantially cylindrical central bore having a diameter substantially equal to said orifice tube and extending for substantially the entire length of said inlet filter, but open only at the downstream end of said inlet filter and abutted concentrically to said orifice tube, whereby a thin, annular inlet manifold space is formed between the outside of said inlet filter and said refrigerant line that forces refrigerant to flow radially inwardly through said inlet filter and concentrically into said central bore and abutted orifice tube over substantially the entire axial length of said inlet filter, said inlet filter having a porosity sufficiently small to trap refrigerant particulate contaminants;

a substantially cylindrical guide sleeve located within said refrigerant line downstream of said expansion valve and forming a small radial clearance space with said refrigerant line, said guide sleeve having at least one discrete port opening into said radial clearance space; and a substantially cylindrical, solid noise attenuation filter body located slidably within said guide sleeve, said filter body having a porosity sufficiently small and an axial length sufficiently large to substantially muffle said refrigerant expansion noise as said refrigeration outlet flow runs through it, said filter body having a discrete non porous outer surface area normally held in axially overlapped relation with said guide sleeve bypass port by an axially yieldable member that compresses sufficiently, should said filter body become blocked by refrigerant contaminants that escape said inlet filter, to allow said filter body to slide axially within said guide sleeve under the pressure of blocked outlet flow far enough to open said bypass port and allow refrigerant to flow into said radial clearance space and around said blocked filter body.

* * * * *